US008052266B2

(12) United States Patent
Nishihara

(10) Patent No.: US 8,052,266 B2
(45) Date of Patent: Nov. 8, 2011

(54) LIQUID DETECTION DEVICE, LIQUID EJECTING APPARATUS, AND METHOD OF DETECTING LIQUID

(75) Inventor: Yuichi Nishihara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 649 days.

(21) Appl. No.: 12/108,251

(22) Filed: Apr. 23, 2008

(65) Prior Publication Data

US 2008/0259136 A1 Oct. 23, 2008

(30) Foreign Application Priority Data

Apr. 23, 2007 (JP) ..... 2007-112785

(51) Int. Cl.
*B41J 2/175* (2006.01)

(52) U.S. Cl. ..... 347/93; 73/290 V

(58) Field of Classification Search ..... 347/11, 347/19, 67, 68, 84
See application file for complete search history.

(56) References Cited

U.S. PATENT DOCUMENTS

| | | | | |
|---|---|---|---|---|
| 4,034,380 | A * | 7/1977 | Isayama | 347/19 |
| 4,733,205 | A * | 3/1988 | Hughes | 333/172 |
| 5,133,005 | A * | 7/1992 | Kelley et al. | 379/146 |
| 5,304,814 | A * | 4/1994 | Markham | 250/573 |
| 5,627,571 | A * | 5/1997 | Anderson et al. | 347/19 |
| 5,929,875 | A * | 7/1999 | Su et al. | 347/19 |
| 6,062,668 | A * | 5/2000 | Cruz-Uribe | 347/19 |
| 6,260,941 | B1 * | 7/2001 | Su et al. | 347/19 |
| 6,290,315 | B1 * | 9/2001 | Sayama | 347/10 |
| 6,335,656 | B1 * | 1/2002 | Goldfarb et al. | 327/559 |
| 6,412,901 | B2 * | 7/2002 | Su et al. | 347/19 |
| 6,478,395 | B2 * | 11/2002 | Tanaka et al. | 347/11 |
| 6,726,318 | B2 * | 4/2004 | Arakawa | 347/106 |
| 6,863,362 | B2 * | 3/2005 | Reichel et al. | 347/19 |
| 7,108,348 | B2 * | 9/2006 | Shinkawa et al. | 347/19 |
| 7,331,645 | B2 * | 2/2008 | Nishihara | 347/10 |
| 7,387,374 | B2 * | 6/2008 | Kawamura | 347/72 |
| 7,452,049 | B2 * | 11/2008 | Ishizaki | 347/19 |
| 7,490,918 | B2 * | 2/2009 | Nagashima | 347/19 |
| 7,636,019 | B1 * | 12/2009 | Lombaard et al. | 331/16 |
| 2001/0015107 | A1 * | 8/2001 | Feller | 73/861.27 |
| 2001/0028371 | A1 * | 10/2001 | Su et al. | 347/19 |
| 2002/0015068 | A1 * | 2/2002 | Tsukada et al. | 347/19 |
| 2003/0086576 | A1 * | 5/2003 | Hlibowicki | 381/96 |
| 2003/0103131 | A1 * | 6/2003 | Arakawa | 347/106 |
| 2004/0021506 | A1 * | 2/2004 | Tanase | 327/552 |

(Continued)

FOREIGN PATENT DOCUMENTS

| | | | |
|---|---|---|---|
| JP | 2001-146030 | A | 5/2001 |
| JP | 2002-154213 | A | 5/2002 |
| JP | 2002-154222 | A | 5/2002 |
| JP | 2002-286525 | A | 10/2002 |
| JP | 2003-112431 | A | 4/2003 |
| JP | 2004-50824 | A | 2/2004 |
| JP | 2004-261970 | A | 9/2004 |
| JP | 2004-261971 | A | 9/2004 |
| JP | 2004-261982 | A | 9/2004 |
| JP | 2006-142515 | A | 6/2006 |
| JP | 2006-212828 | A | 8/2006 |

*Primary Examiner* — Charlie Peng
*Assistant Examiner* — Peter Radkowski
(74) *Attorney, Agent, or Firm* — Sughrue Mion, PLLC

(57) ABSTRACT

A liquid detection device that drives a liquid detecting portion includes a driving portion, a signal detecting portion, a high-pass filter portion, a first switch, and a control portion. The driving portion supplies a driving signal or a preliminary charging voltage to the liquid detecting portion. The signal detecting portion receives a detection signal from the liquid detecting portion. The high-pass filter portion has a capacitor portion and is arranged between the liquid detecting portion and the signal detecting portion. The first switch is arranged between the liquid detecting portion and the high-pass filter portion, and electrically connects or interrupts a line between the liquid detecting portion and the high-pass filter portion. The control portion controls the driving portion and the first switch to execute detection of liquid.

11 Claims, 8 Drawing Sheets

U.S. PATENT DOCUMENTS

2004/0167417 A1* 8/2004 Schulhauser et al. ..... 600/513
2004/0168514 A1* 9/2004 Tsukada et al. ..... 73/290 V
2005/0186932 A1* 8/2005 Kurimoto et al. ..... 455/284
2005/0253890 A1* 11/2005 Nagashima ..... 347/19
2006/0038858 A1* 2/2006 Ishizaki ..... 347/68
2006/0181369 A1* 8/2006 Shibahara ..... 333/195
2006/0187249 A1* 8/2006 Nishihara ..... 347/7
2006/0208809 A1* 9/2006 Erdogan ..... 331/17
2006/0232281 A1* 10/2006 Vittorio et al. ..... 324/652
2006/0272404 A1* 12/2006 Usui et al. ..... 73/290 V
2007/0276270 A1* 11/2007 Tran ..... 600/508
2008/0026719 A1* 1/2008 Chiu et al. ..... 455/296
2008/0074460 A1* 3/2008 Edwards et al. ..... 347/19
2008/0183076 A1* 7/2008 Witte et al. ..... 600/438
2009/0039967 A1* 2/2009 Schechinger ..... 331/10
2009/0046121 A1* 2/2009 Ishizaki ..... 347/19

* cited by examiner

FIG. 4
| | PRELIMINARY CHARGING | DRIVING | DETECTING |
|---|---|---|---|
| SW1 | ON | OFF | ON |
| SW2 | ON | ON | OFF |
| SW3 | ON | OFF | ON |
| SW4 | ON | ON | OFF |
FIG. 5
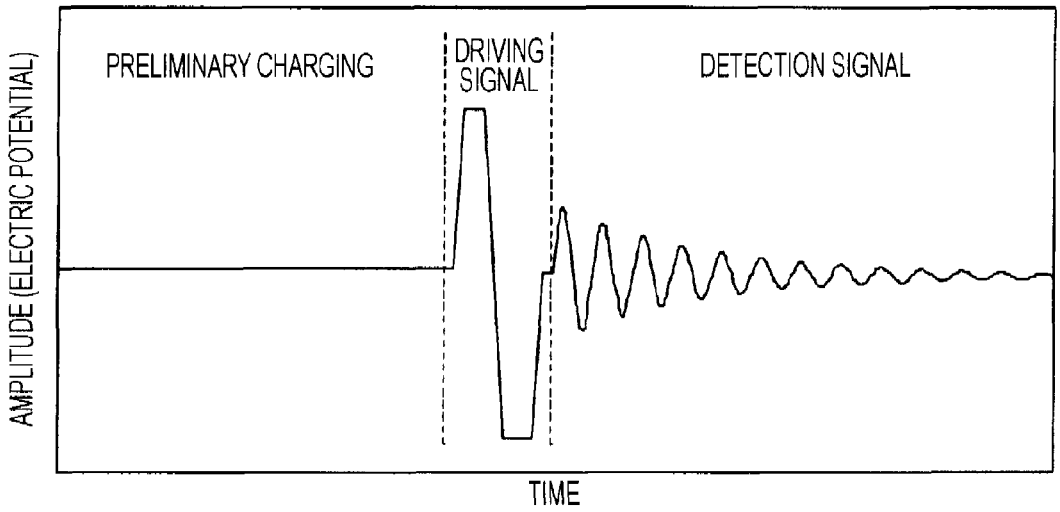
FIG. 6
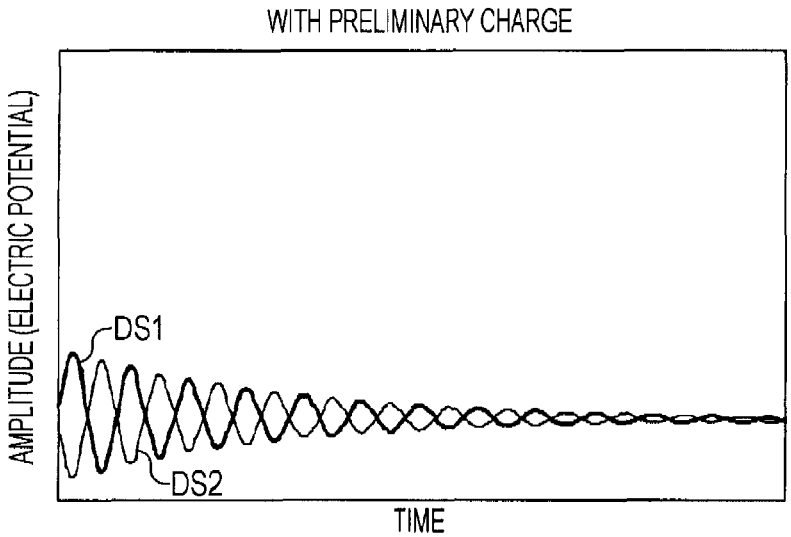

| | PRELIMINARY CHARGING | DRIVING | DETECTING |
|---|---|---|---|
| SW1 | ON | OFF | ON |
| SW2 | ON | ON | OFF |

| | PRELIMINARY CHARGING | DRIVING | DETECTING |
|---|---|---|---|
| SW1 | ON | OFF | ON |
| SW4 | ON | ON | OFF |

LIQUID DETECTION DEVICE, LIQUID EJECTING APPARATUS, AND METHOD OF DETECTING LIQUID

BACKGROUND

1. Technical Field

The present invention relates to a liquid detection device and method that detects the presence or absence of liquid by driving a liquid detecting portion and also to a liquid ejecting apparatus that uses the liquid detection device.

2. Related Art

For example, a technology for detecting the presence or absence of ink in an ink cartridge is known as a liquid detection device. In the above technology, a piezoelectric element is used as a sensor, and then the presence or absence of ink is detected using a counter electromotive voltage waveform that is obtained after the piezoelectric element is driven. Specifically, an ink flow passage is provided adjacent to the piezoelectric element, and it is determined whether a counter electromotive voltage waveform output from the piezoelectric element because of residual oscillation coincides with a resonance frequency that is obtained when the ink flow passage is filled with ink or the counter electromotive voltage waveform coincides with a resonance frequency that is obtained when the ink flow passage is not filled with ink, so that it is determined whether the amount of ink contained in the ink cartridge is equal to or above a predetermined amount, which is, for example, described in JP-A-2001-146030.

However, because the counter electromotive voltage waveform oscillates with respect to the termination voltage at the time when application of a driving signal to the piezoelectric element is completed, when a low frequency component is intended to be removed using a high-pass filter that includes a capacitor portion, there is a problem that the low frequency component cannot be sufficiently removed until the capacitor portion is charged by the termination voltage. In addition, when the counter electromotive voltage waveform is measured after the capacitor portion has been charged, there is a problem that an oscillation attenuates, an S/N ratio deteriorates and, hence, the detection accuracy decreases.

SUMMARY

An advantage of some aspects of the invention is that it improves the detection accuracy in a liquid detection device.

The following aspects of the invention may be employed.

A first aspect of the invention provides a liquid detection device that drives a liquid detecting portion. The liquid detection device according to the first aspect of the invention includes a driving portion, a signal detecting portion, a high-pass filter portion, a first switch, and a control portion. The driving portion supplies a driving signal or a preliminary charging voltage to the liquid detecting portion. The signal detecting portion receives a detection signal from the liquid detecting portion. The high-pass filter portion has a capacitor portion and is arranged between the liquid detecting portion and the signal detecting portion. The first switch is arranged between the liquid detecting portion and the high-pass filter portion, and electrically connects or interrupts a line between the liquid detecting portion and the high-pass filter portion. The control portion controls the driving portion and the first switch to execute detection of liquid.

According to the liquid detection device according to the first aspect of the invention, the first switch that electrically connects or interrupts a line between the liquid detecting portion and the high-pass filter portion and a control portion that executes detection of liquid by controlling the driving portion and the first switch are provided, it is possible to improve the detection accuracy in the liquid detection device.

The liquid detection device according to the first aspect of the invention may further include a second switch that is arranged between the driving portion and the liquid detecting portion and that is controlled by the control portion to electrically connect or interrupt a line between the driving portion and the liquid detecting portion, wherein the control portion, before the driving signal is applied to the liquid detecting portion, may control the first switch to electrically connect a line between the liquid detecting portion and the high-pass filter portion, control the second switch to electrically connect a line between the driving portion and the liquid detecting portion, and control the driving portion to apply the preliminary charging voltage to the liquid detecting portion. In this case, it is possible to improve the ability to remove a low frequency component by the high-pass filter portion when liquid is detected thereafter.

In the liquid detection device according to the first aspect of the invention, the control portion, when liquid is detected, may control the first switch to electrically interrupt a line between the liquid detecting portion and the high-pass filter portion, control the second switch to electrically connect a line between the driving portion and the liquid detecting portion, and control the driving portion to apply the driving signal to the liquid detecting portion, then control the first switch to electrically connect a line between the liquid detecting portion and the high-pass filter portion, and control the second switch to electrically interrupt a line between the driving portion and the liquid detecting portion. In this, case, because detection of liquid may be performed using the detection signal before the amplitude of the detection signal output from the liquid detecting portion attenuates, it is possible to improve the detection accuracy in the liquid detection device.

In the liquid detection device according to the first aspect of the invention, the first switch may be arranged between the liquid detecting portion and the capacitor portion. In this case, because, in advance of detection of liquid, the capacitor portion of the high-pass filter portion is charged with the preliminary charging voltage being applied, it is possible to immediately remove a low frequency component when liquid is detected without waiting to charge the capacitor portion.

In the liquid detection device according to the first aspect of the invention, the liquid detecting portion may include a plurality of terminals and may be provided on a liquid containing body that is detachable from the liquid detection device, wherein the liquid detection device may further include a plurality of device terminals that are formed at an attachment portion that attaches the liquid containing body and that contact the terminals of the liquid detecting portion, wherein the plurality of device terminals may include a first attachment terminal and a second attachment terminal that is different from the first device terminal, wherein the driving portion may be electrically connected to the first attachment terminal, and the signal detecting portion may be electrically connected to the first attachment terminal or the second attachment terminal. In this case, even when the liquid detecting portion is separately formed from the liquid detection device, it is possible to improve the detection accuracy in the liquid detection device.

In the liquid detection device according to the first aspect of the invention, the liquid detecting portion may include a first electrode and a second electrode, wherein the high-pass filter portion may include first and second input portions that are electrically connected to the first and second electrodes, respectively, wherein the first switch may be arranged between the first electrode and the first input portion, wherein the liquid detection device may further include a ground portion, a second switch that is arranged between the driving portion and the first electrode and that electrically connects or interrupts a line between the driving portion and the first electrode, a third switch that is arranged between the second input portion and the second electrode and that electrically connects or interrupts a line between the second input portion and the second electrode, and a fourth switch that is arranged between the ground portion and the second electrode and that electrically connects or interrupts a line between the ground portion and the second electrode. In this case, when the control portion appropriately controls the first to fourth switches, it is possible to improve the detection accuracy in the liquid detection device.

In the liquid detection device according to the first aspect of the invention, the liquid detecting portion may output mutually opposite-phase detection signals by receiving an input of the driving signal, wherein the high-pass filter portion may include first and second output portions, wherein the liquid detection device may further include a differential amplifier that is arranged between the signal detecting portion and the high-pass filter portion, that includes first and second input portions to which the first and second output portions of the high-pass filter portion are electrically connected, respectively, and that performs differential amplification on the mutually opposite-phase detection signals. In this case, by performing differential amplification on the detection signals, it is possible to further improve the detection accuracy in the liquid detection device.

In the liquid detection device according to the first aspect of the invention, the liquid detecting portion may include a plurality of terminals and may be provided on a liquid containing body that is detachable from the liquid detection device, wherein the liquid detection device may further include a plurality of device terminals that are formed at an attachment portion that attaches the liquid containing body and that contact the terminals of the liquid detecting portion, wherein the plurality of device terminals may include a first attachment terminal and a second attachment terminal that is different from the first attachment terminal, wherein the driving portion may be electrically connected to the first attachment terminal, the ground portion may be electrically connected to the second attachment terminal, and the signal detecting portion may be electrically connected to the first attachment terminal and the second attachment terminal. In this case, even when the liquid detecting portion is separately formed from the liquid detection device, it is possible to improve the detection accuracy in the liquid detection device.

In the liquid detection device according to the first aspect of the invention, the control portion, before the driving signal is applied to the liquid detecting portion, may control the first switch to electrically connect a line between the liquid detecting portion and the high-pass filter portion, and control the driving portion to apply the preliminary charging voltage to the liquid detecting portion. In this case, it is possible to improve the ability to remove a low frequency component by the high-pass filter portion when liquid is detected thereafter.

In the liquid detection device according to the first aspect of the invention, the control portion, when liquid is detected, may control the first switch to electrically interrupt a line between the liquid detecting portion and the high-pass filter portion, control the driving portion to apply the driving signal to the liquid detecting portion, then control the first switch to electrically connect a line between the liquid detecting portion and the high-pass filter portion, and control the driving portion to stop applying the driving signal to the liquid detecting portion. In this case, because detection of liquid may be performed using the detection signal before the amplitude of the detection signal output from the liquid detecting portion attenuates, it is possible to improve the detection accuracy in the liquid detection device.

In the liquid detection device according to the first aspect of the invention, the driving signal may be biased to a predetermined electric potential, and wherein the electric potential of the preliminary charging voltage may be the predetermined electric potential. In this case, because the capacitor portion of the high-pass filter portion is charged at the predetermined electric potential to which the driving signal is biased, it is possible to immediately remove or reduce-a low frequency component that is included in the detection signal.

A second aspect of the invention provides a method of detecting liquid in the liquid detection device. The method of detecting liquid according to the second aspect of the invention includes electrically connecting a line between a liquid detecting portion and a high-pass filter portion, applying a preliminary charging voltage to the liquid detecting portion, electrically interrupting a line between the liquid detecting portion and the high-pass filter portion, applying a driving signal to the liquid detecting portion, electrically connecting a line between the liquid detecting portion and the high-pass filter portion, and detecting the presence or absence of the liquid using a detection signal output from the liquid detecting portion through the high-pass filter portion.

According to the method of detecting liquid according to the second aspect of the invention, it is possible to obtain the same functions and advantageous effects as those of the liquid detection device according to the first aspect of the invention. In addition, the method of detecting liquid according to the second aspect of the invention may be implemented in various modes as in the case of the liquid detection device according to the first aspect of the invention. Furthermore, the method of detecting liquid according to the second aspect of the invention may be implemented as a computer program that is executed by a computer; or may be implemented as a recording medium that stores the computer program.

BRIEF DESCRIPTION OF THE DRAWINGS

The invention will be described with reference to the accompanying drawings, wherein like numbers reference like elements.

FIG. 4 is a view that illustrates one example of on/off control patterns of switches, which are used in the first embodiment, in each mode.

FIG. 5 is a view that schematically shows a preliminary charging voltage signal and a driving signal, which are output from a driving portion, and a detection signal output from a liquid detecting portion in the first embodiment.

FIG. 6 is a view that schematically illustrates detection signals input to a differential amplifier in the liquid detection device according to the first embodiment.

DESCRIPTION OF EXEMPLARY EMBODIMENTS

Hereinafter, embodiments of a liquid detection device according to the aspects of the invention will be described with reference to the accompanying drawings.

First Embodiment

Figure 1:
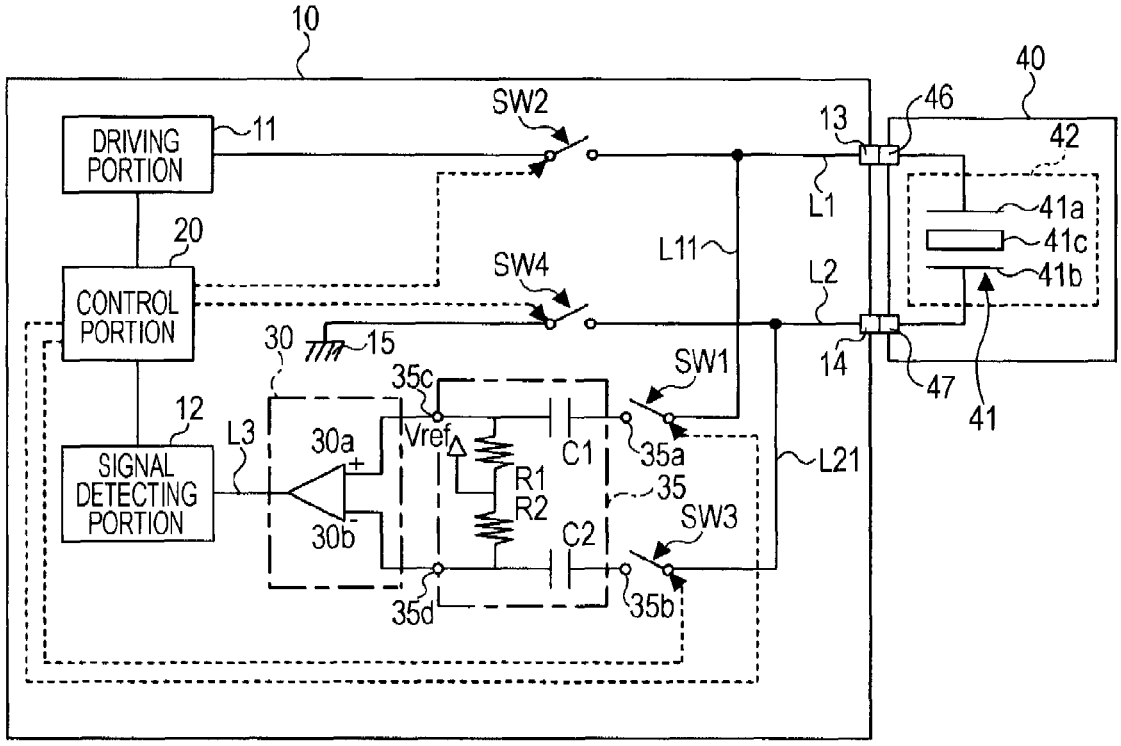
FIG. 1 is a view that schematically illustrates the internal configuration of a liquid detection device according to a first embodiment.
Figure 2:
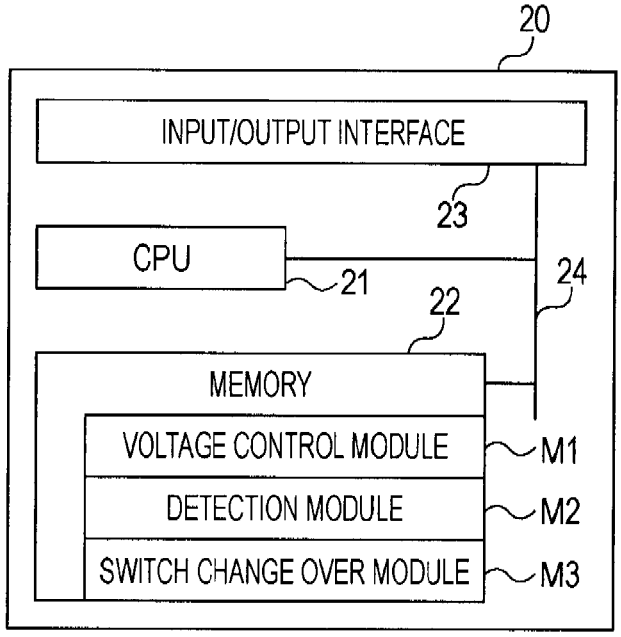
FIG. 2 is a view that schematically illustrates the internal configuration of a control portion of the liquid detection device according to the first embodiment.

The configuration of a liquid detection device according to the first embodiment will be described with reference to FIG. 1 and FIG. 2. FIG. 1 is a view that schematically illustrates the internal configuration of the liquid detection device according to the first embodiment. FIG. 2 is a view that schematically illustrates the internal configuration of a control portion of the liquid detection device according to the first embodiment.

FIG. 1 shows a liquid detection device 10 according to the first embodiment and a liquid containing body 40 that is attached to the liquid detection device 10 according to the present embodiment and then used. In the present embodiment, the liquid detection device 10 and the liquid containing body 40 are separately formed, and the liquid containing body 40 is detachably attached to the liquid detection device 10.

Configuration of Liquid Containing Body

For easier description, the configuration of the liquid containing body will be initially described. The liquid containing body 40 includes a liquid detecting portion 41, a liquid containing portion 42, a first terminal 46 and a second terminal 47. The liquid detecting portion 41 detects whether liquid is present in the liquid containing portion 42. Specifically, the liquid detection portion 41 detects whether liquid that is equal to or above a predetermined amount is present in the liquid containing portion 42. The liquid detecting portion 41, which is used in the present embodiment, uses a piezoelectric element 41*c* as a sensor, and the piezoelectric element 41*c* is held between a first electrode 41*a* and a second electrode 41*b*. Note that the liquid detecting portion 41 is not limited to the piezoelectric element 41*c*, but it may employ an electromechanical energy transducing element, as a sensor, that outputs opposite-phase detection signals to the first electrode 41*a* and the second electrode 41*b*.

The first electrode 41*a* of the liquid detecting portion 41 is connected to the first terminal 46, and the second electrode 41*b* of the liquid detecting portion 41 is connected to the second terminal 47. As a voltage is applied through the first terminal 46 and the first electrode 41*a* to the piezoelectric element 41*c*, the piezoelectric element 41*c* that is applied with the voltage deforms because of the inverse piezoelectric effect. In this state, as the application of the voltage to the first terminal 46 is released, electric charge that is charged in the piezoelectric element 41*c* is discharged. Thus, the piezoelectric element 41*c* oscillates at the natural frequency (resonance frequency) of a system that includes the liquid detecting portion 41. Here, because the system that includes the liquid detecting portion 41 also includes liquid, the natural frequency differs depending on the presence or absence of liquid.

The piezoelectric element 41*c* outputs a counter electromotive voltage signal (detection signal) that is generated by the oscillation. Counter electromotive voltage signals that are output from the piezoelectric element 41*c* through the first electrode 41*a* and the second electrode 41*b* are in opposite phase. On the other hand, an exogenous noise (external noise) applied to the liquid detecting portion 41 from the outside is carried on detection signals output from the first electrode 41*a* and from the second electrode 41*b* in phase.

Configuration of Liquid Detection Device

The liquid detection device 10 according to the first embodiment includes a driving portion 11, a signal detecting portion 12, a control portion 20, a differential amplifier 30, a high-pass filter portion 35, a first switch SW1, a second switch SW2, a third switch SW3, a fourth switch SW4, a first device side terminal 13 and a second device side terminal 14 as main components.

The driving portion 11 is connected to the first device side terminal 13 through a first signal line L1. The second switch SW2 is arranged in the first signal line L1 in order to electrically connect or interrupt a line between the driving portion 11 and the first device side terminal 13. A ground portion 15 is connected to the second device side terminal 14 through a second signal line L2. The fourth switch SW4 is arranged in the second signal line L2 in order to electrically connect or interrupt a line between the ground portion 15 and the second device side terminal 14. Note that the second switch SW2 need not be provided in the first signal line L1 and, for example, it may be configured so that the first signal line L1 may be interrupted from a driving signal source in the driving portion 11.

In the first signal line L1, a first input portion 35*a* of the high-pass filter portion 35 is connected between the second switch SW2 and the first device side terminal 13 through a first detection signal line L1. The first switch SW1 is arranged in the first detection signal line L11 in order to electrically connect or interrupt a line between the high-pass filter portion 35 (first input portion 35*a*) and the first device side terminal 13. In the second signal line L2, a second input portion 35*b* of the high-pass filter portion 35 is connected between the fourth switch SW4 and the second device side terminal 14 through a second detection signal line L21. The third switch SW3 is arranged in the second detection signal line L21 in order to electrically connect or interrupt a line between the high-pass filter portion 35 (second input portion 35*b*) and the second device side terminal 14.

The differential amplifier 30 is connected to the output side of the high-pass filter portion 35. Specifically, a first output portion 35*c* of the high-pass filter portion 35 is connected to a first input portion 30*a* of the differential amplifier 30, and a second output portion 35*d* of the high-pass filter portion 35 is connected to a second input portion 30*b* of the differential amplifier 30.

The signal detecting portion 12 is connected to the output portion of the differential amplifier 30 through a third signal line L3.

The driving portion 11 applies a driving signal having a predetermined driving waveform or a preliminary charging voltage in advance of the output of the driving signal, to the liquid detecting portion 41 that is provided in the liquid containing body 40. The driving signal is, for example, generated as follows. Driving waveform data are recorded in the driving portion 11 in advance. The driving portion 11 acquires the driving waveform data and performs digital-analog conversion on the data, and then executes integration. Thus, the driving signal having a predetermined waveform is generated. Note that the driving signal is biased to a predetermined electric potential in order to easily handle a negative electric potential (amplitude) that appears depending on the driving waveform. Thus, the signal may be regarded as a signal that oscillates with respect to a predetermined electric potential that is used as an intermediate electric potential. The preliminary charging voltage, when a detection signal is detected after application of a driving signal, is a voltage that is applied in advance to the high-pass filter portion 35 in order to sufficiently increase the removal or suppression capability against a direct current component and/or a low frequency component in the high-pass filter portion 35. The preliminary charging voltage, for example, has a value that is equivalent to a voltage applied to both electrodes 41*a* and 41*b* of the liquid detecting portion 41 when application of the driving signal is completed. Note that, as described above, because the driving signal is biased to a predetermined electric potential, the preliminary charging voltage may be regarded as a predetermined electric potential that biases the driving signal.

The driving portion 11 drives the liquid detecting portion 41 using a driving waveform that matches a natural frequency equivalent to a natural frequency when liquid sufficiently remains in the liquid containing portion 42 of the liquid containing body 40, that is, when liquid is included in a system that includes the liquid detecting portion 41, or when only a predetermined amount or below of liquid remains in the liquid containing portion 42, that is, when liquid is not included in the system that includes the liquid detecting portion 41.

The signal detecting portion 12 detects (determines) whether liquid is present in the liquid containing body 40 using a differential-amplified detection signal that is input from the differential amplifier 30. Specifically, by measuring the oscillation frequency of the differential-amplified detection signal, it is detected (determined) whether liquid is present in the liquid containing body 40. The oscillation frequency of the differential-amplified detection signal represents a natural frequency of a structure (cabinet or liquid) around the liquid detecting portion 41 that oscillates together with the liquid detecting portion 41. The oscillation frequency varies in accordance with the amount of liquid that remains in the liquid containing portion. Thus, on the basis of whether the differential-amplified detection signal having an oscillation frequency used for detection can be measured from the liquid detecting portion 41 that is driven using the above driving signal, it is possible to determine whether a sufficient amount of liquid is present in the liquid containing portion.

The high-pass filter portion 35 removes a low frequency component and a direct current component that are included in a detection signal. That is, by removing a direct current component, it is possible to use an amplifier circuit having a low withstand voltage for the differential amplifier 30. In addition, in the present embodiment, because the liquid detecting portion 41 uses the piezoelectric element 41*c*, which is a ferroelectric substance, low frequency oscillations of voltages are generated. These low frequency oscillations are in opposite phase as well as the detection signals. Thus, they cannot be removed by differential amplification; however, they can be removed by the high-pass filter portion 35. As a result, it is possible to improve the measurement accuracy of the detection signal.

The high-pass filter portion 35 includes an RC filter circuit that consists of a first capacitor C1 and a first resistance R1 for the first detection signal line L11 and an RC filter circuit that consists of a second capacitor C2 and a second resistance R2 for the second detection signal line L21. Each filter circuit is applied with a reference electric potential Vref on which the detection signal should converge.

The differential amplifier 30 uses a difference between the detection signals that are output from the first and second output portions 35*c* and 35*d* of the high-pass filter portion 35 and input to the first and second input portions 30*a* and 30*b* thereof, and then amplifies the detection signals to thereby generate an amplified detection signal. As described above, the liquid detecting portion 41, which is used in the present embodiment, uses the piezoelectric element 41*c* as a sensor, and detection signals output from the piezoelectric element 41*c* are in opposite phase. Thus, it is possible to amplify the amplitude (electric potential) of the detection signals by the differential amplifier 30, while, on the other hand, it is possible to reduce or remove the influence of exogenous noises that are carried on the detection signals in phase. The differential amplifier 30 employs a known differential amplifier circuit.

The driving portion 11, the signal detecting portion 12, the first switch SW1, the second switch SW2, the third switch SW3 and the fourth switch SW4 are connected through a control signal line to the control portion 20. The control portion 20, as shown in FIG. 2, includes a central processing unit (CPU) 21 that executes processing, a memory 22 that stores the processing result, a liquid detection process execution program, or the like, and an input/output interface 23 that electrically connects the CPU 21 and the memory 22 with external circuits (the driving portion 11 and the signal detecting portion 12) and the first to fourth switches SW1 to SW4. The CPU 21, the memory 22 and the input/output interface 23 are connected to each other by an internal bus 24. Note that the first switch SW1 to the fourth switch SW4 may use various transistors or various switching circuits.

The memory 22 stores a voltage control module M1 that is executed by the CPU 21 and requests the driving portion 11 to output a preliminary charging voltage or a driving signal, a detection module M2 that requests the signal detecting portion 12 to determine the presence or absence of liquid, and a switch change over module M3 that controls on/off of the first to fourth switches SW1 to SW4.

Liquid Detection Process

Figure 3:
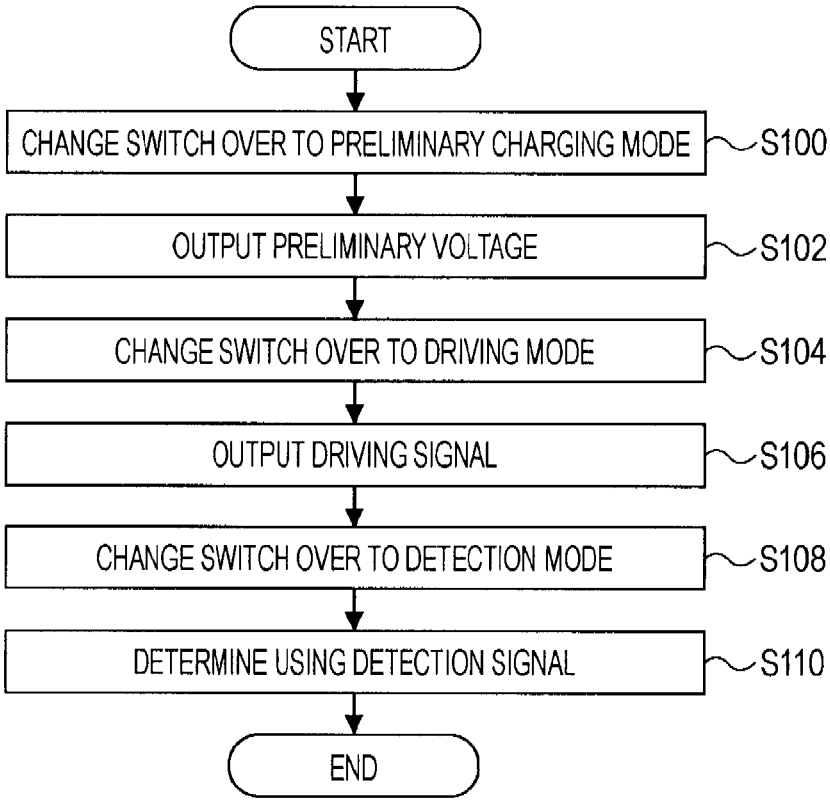
FIG. 3 is a flowchart that shows a liquid detection process that is executed in the first embodiment.

The flow of liquid detection process in the present embodiment will be described with reference to FIG. 1, FIG. 3 and FIG. 4. FIG. 3 is a flowchart that shows the liquid detection process that is executed in the first embodiment. FIG. 4 is a view that illustrates one example of on/off control patterns of switches, which are used in the first embodiment, in each mode.

As the liquid detection process is started, the control portion 20 (CPU 21) executes the switch change over module M3 to thereby change the first to fourth switches SW1 to SW4 over to the mode of preliminary charging (step S100). That is, the first to fourth switches SW1 to SW4 are turned on in conformity to the mode of preliminary charging shown in FIG. 4. As a result, the driving portion 11, the liquid detecting portion 41 and the high-pass filter portion 35 are electrically connected.

The CPU 21 executes the voltage control module M1 to output a preliminary charging voltage from the driving portion 11 (step S102). The preliminary charging voltage output from the driving portion 11 is applied to the liquid detecting portion 41 and the high-pass filter portion 35. As described above, the electric potential of the preliminary charging voltage is an electric potential at which application of a driving signal is completed, and the preliminary charging voltage (signal) only includes a DC component and does not include an oscillating component (AC component). Thus, the first and second capacitors C1 and C2 in the high-pass filter portion 35 are charged with the electric potential of the preliminary charging voltage, that is, an electric potential at which application of a driving signal is completed.

The CPU 21 executes the switch change over module M3 to thereby change the first to fourth switches SW1 to SW4 over to the mode of driving (step S104). That is, the second and fourth switches SW2 and SW4 are turned on and the first and third switches SW1 and SW3 are turned off in conformity to the mode of driving shown in FIG. 4. As a result, the driving portion 11 and the liquid detecting portion 41 are electrically connected, and the driving portion 11 and the high-pass filter portion 35 are electrically interrupted.

The CPU 21 executes the voltage control module M1 to output a driving signal from the driving portion 11 (step S106). Because the second and fourth switches SW2 and SW4 are turned on, the driving signal output from the driving portion 11 flows through the first electrode 41*a*, the piezoelectric element 41*c* and the second electrode 41*b* to the ground portion 15. As a result, the piezoelectric element 41*c* in the liquid detecting portion 41 is electrostricted by the driving signal. In addition, because the driving portion 11 and the high-pass filter portion 35 are electrically interrupted from each other, the high-pass filter portion 35 is never applied with the driving signal and, therefore, the electrical state of the high-pass filter portion 35 is not disturbed by the AC component of the driving signal.

The CPU 21 executes the switch change over module M3 to thereby change the first to fourth switches SW1 to SW4 over to the mode of detecting (step S108). That is, the second and fourth switches SW2 and SW4 are turned off and the first and third switches SW1 and SW3 are turned on in conformity to the mode of detecting shown in FIG. 4. As a result, the driving portion 11 and the liquid detecting portion 41 are electrically interrupted, and the liquid detecting portion 41 and the high-pass filter portion 35 are electrically connected.

As a result, the piezoelectric element 41*c* oscillates at a natural frequency of a system that includes the liquid detecting portion 41, and opposite-phase counter electromotive waveform signals, that is, detection signals, are output from the electrodes 41*a* and 41*b* of the liquid detecting portion 41. The detection signals output from the electrodes are input to the high-pass filter portion 35 through the first and second detection signal lines L11 and L21 and the first and third switches SW1 and SW3, respectively. In the high-pass filter portion 35, a direct current component and a low frequency component, which are included in each detection signal, are reduced or removed.

In the high-pass filter portion 35, each detection signal of which a low frequency component and a direct current component are reduced or eliminated is input to the differential amplifier 30, and the amplitude (voltage) of the detection signal is amplified using a differential between the detection signals. As a result, a differential-amplified detection signal, in which in-phase exogenous noise that is superposed on each detection signal is reduced or suppressed is obtained and then input to the signal detecting portion 12. The CPU 21 executes the detection module M2 to thereby determine whether the differential-amplified detection signal coincides with a predetermined natural frequency (resonance frequency) using the signal detecting portion 12 (step S110). When the differential-amplified detection signal coincides with the predetermined natural frequency, it is determined that a predetermined amount or above of liquid is present in the liquid containing body 40. On the other hand, when the differential-amplified detection signal does not coincides with the predetermined natural frequency, it is determined that a predetermined amount or above of liquid is not present in the liquid containing body 40.

Note that turning on the second and fourth switches SW2 and SW4 means that the driving portion 11 and the liquid detecting portion 41 (first electrode 41*a*) are electrically connected and the ground portion 15 and the liquid detecting portion 41 (second electrode 41*b*) are electrically connected. On the other hand, turning off the second and fourth switches SW2 and SW4 means that the driving portion 11 and the liquid detecting portion 41 (first electrode 41*a*) are electrically interrupted and the ground portion 15 and the liquid detecting portion 41 (second electrode 41*b*) are electrically interrupted. In addition, turning on the first and third switches SW1 and SW3 means that the driving portion 11 or the liquid detecting portion 41 (first electrode 41*a*) and the high-pass filter portion 35 (first input portion 35*a*) are electrically connected and the ground portion 15 or the liquid detecting portion 41 (second electrode 41*b*) and the high-pass filter portion 35 (second input portion 35*b*) are electrically connected. In addition, turning off the first and third switches SW1 and SW3 means that the driving portion 11 or the liquid detecting portion 41 (first electrode 41*a*) and the high-pass filter portion 35 (first input portion 35*a*) are electrically interrupted and the ground portion 15 or the liquid detecting portion 41 (second electrode 41*b*) and the high-pass filter portion 35 (second input portion 35*b*) are electrically interrupted.

Figure 7:
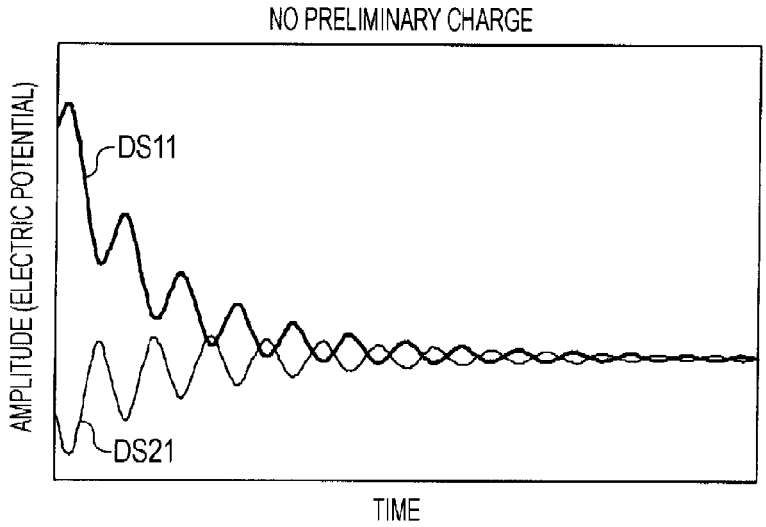
FIG. 7 is a view that schematically illustrates detection signals input to a differential amplifier in a liquid detection device according to the existing art.

With reference to FIG. 5 to FIG. 7, the advantageous effects obtained by the liquid detection device 10 according to the first embodiment will be described. FIG. 5 is a view that schematically shows a preliminary charging voltage signal and a driving signal, which are output from the driving portion, and a detection signal output from the liquid detecting portion in the first embodiment. FIG. 6 is a view that schematically illustrates detection signals input to the differential amplifier in the liquid detection device according to the first embodiment. FIG. 7 is a view that schematically illustrates detection signals input to a differential amplifier in a liquid detection device according to the existing art. Here, FIG. 6 shows detection signals DS1 and DS2 that are respectively input to the first input portion 30*a* and second input portion 30*b* of the differential amplifier 30 after the timing at which the detection signals are output from the liquid detecting portion 41.

As described above, in the present embodiment, in advance of application of a driving signal to the liquid detecting portion 41, a preliminary charging voltage is output from the driving portion 11. This preliminary charging voltage, as is apparent from FIG. 5, has an electric potential that is equal to the intermediate electric potential of the driving signal. As the preliminary charging voltage is applied, the first and second capacitors C1 and C2 in the high-pass filter portion 35 are preliminarily charged. The driving signal output from the driving portion 11 is a voltage that has a pulse waveform shown in FIG. 5. After a pulse waveform voltage is applied to the piezoelectric element 41*c*, as the second and fourth switches SW2 and SW4 are turned off, the piezoelectric element 41*c* oscillates at a natural frequency of a system that includes the liquid detecting portion 41 and then, as shown in FIG. 5, outputs a detection signal that is biased to the intermediate electric potential of the driving signal. The piezoelectric element 41*c* outputs opposite-phase detection signals to the first and second electrodes 41*a* and 41*b*, respectively. That is, opposite-phase detection signals are output to the first and second signal lines L1 and L2, respectively, and also output to the first and second detection signal lines L11 and L21, respectively.

The detection signals output to the first and second detection signal lines L11 and L21 are input through the high-pass filter portion 35 to the differential amplifier 30. In the present embodiment, because the capacitor portions C1 and C2 in the high-pass filter portion 35 are charged with the intermediate electric potential of the driving signal in advance, as shown in FIG. 6, it is possible to immediately remove or reduce a direct current component and a low frequency component that are included in the detection signals DS1 and DS2. That is, the high-pass filter portion 35 cannot sufficiently remove direct current components of the detection signals until the first and second capacitors C1 and C2 are charged with the electric potentials of direct current components of the detection signals DS1 and DS2; however, in the present embodiment, because the high-pass filter portion 35 is applied with a preliminary charging voltage in advance, it is possible to immediately converge the intermediate electric potential of the detection signals DS1 and DS2 on a reference electric potential.

As a result, a differential-amplified detection signal may be generated at the timing at which the amplitude is sufficiently large immediately after the detection signals DS1 and DS2 are output, so that it is possible to remove or reduce the influence of exogenous noise that is carried on the detection signals. That is, in the present embodiment, because a difference in electric potential (a difference in intermediate electric potential between the detection signals DS1 and DS2) input to the differential amplifier 30 is small from the beginning when the detection signals DS1 and DS2 are output, it is possible to nestle the difference in input electric potential within a prescribed difference in input electric potential in the differential amplifier 30. Thus, an output signal output from the differential amplifier 30 is not saturated, and it is possible to obtain differential-amplified detection signal having a waveform from the beginning when the detection signals DS1 and DS2 are output. In addition, in the present embodiment, because the waveforms of the detection signals DS1 and DS2 are symmetrical with respect to each other (the intermediate electric potentials of both detection signals DS1 and DS2 are equal electric potential) from the beginning when the detection signals DS1 and DS2 are output, it is possible to generate the differential-amplified detection signal in the differential amplifier 30.

Furthermore, generally, when the gradient of voltage variation at which the intermediate electric potential of the detection signal converges on a reference electric potential is large, an error tends to occur in measurement of frequency or measurement of amplitude and, in addition, there is a possibility that measurement cannot be performed because an oscillation component is buried in voltage variation. However, in the liquid detection device 10 according to the present embodiment, because a preliminary charging voltage having an electric potential equal to the intermediate electric potential is applied to the high-pass filter portion 35 in advance, the intermediate electric potential of each detection signal initially converges on the reference electric potential. Thus, it is possible to avoid the above inconvenience. Thus, it is possible to detect (determine) the presence or absence of liquid with high accuracy.

In contrast, in the embodiment according to the existing art, which does not perform preliminary charging, shown in FIG. 7, a direct current component included in each of the detection signals DS11 and DS21 is not removed until the capacitor portions in the high-pass filter portion are charged. By the time when a direct current component included in each of the detection signals DS11 and DS21 is removed, the amplitude of each of the detection signals DS11 and DS21 attenuates and, as a result, an S/N ratio deteriorates. Thus, the accuracy of detecting liquid has been decreased. Note that the amplitude of the detection signal DS11 is large in FIG. 7 because the reference electric potential Vref is close to the negative electric potential.

As described above, according to the liquid detection device 10 according to the first embodiment, the first and third switches SW1 and SW3 are provided, the high-pass filter portion 35 is applied with a preliminary charging voltage in advance, and the capacitor portions C1 and C2 are preliminarily charged, it is possible to obtain the differential-amplified detection signal immediately after the detection signals are output from the liquid detecting portion 41. As a result, the differential-amplified detection signal may be generated at the timing at which the amplitude of each of the detection signals is large, so that it is possible to remove or reduce in-phase exogenous noise included in each of the detection signals. Thus, it is possible to improve the accuracy of detecting liquid.

In addition, in the liquid detection device 10 according to the present embodiment, because the first and third switches SW1 and SW3 are provided, it is possible to electrically isolate the high-pass filter portion 35 from the driving portion 11 while the driving signal is applied to the liquid detecting portion 41. Thus, the state of the high-pass filter portion 35 in which the capacitor portions C1 and C2 are charged is never disturbed by the driving signal. As a result, immediately after application of the driving signal to the liquid detecting portion 41 is completed, the differential-amplified detection signal may be generated from the state in which the high-pass filter portion 35 is stable and then detection (determination) of the presence or absence of liquid may be executed.

Furthermore, in the liquid detection device 10 according to the present embodiment, because the intermediate electric potential of each of the detection signals DS1 and DS2 may be removed or reduced in the high-pass filter portion 35 from the beginning of generation of the detection signals DS1 and DS2, it is not necessary to increase the withstand voltage of the differential amplifier 30 and, hence, it is possible to suppress costs. That is, even when the reference electric potential Vref is close to the negative electric potential, the intermediate electric potential of the detection signal DS1 may be quickly converged on the reference electric potential Vref, so that it is only necessary to use the differential amplifier 35 that has a withstand voltage characteristic in a predetermined range that sets the reference electric potential Vref as a center. In contrast, when the reference electric potential Vref is set for the intermediate electric potential between the positive side and the negative side, the withstand voltage characteristic required for the differential amplifier 35 increases. In addition, generally, even when the reference electric potential Vref is set for the intermediate electric potential between the positive side and the negative side, symmetry of the circuit will collapse because of unevenness in circuit components, a parasitic capacitance, or the like. In the liquid detection device 10 according to the present embodiment, as described above, even when symmetry of the circuit is not maintained, the intermediate electric potential of each of the detection signals DS1 and DS2 may be quickly converged on the reference electric potential Vref, so that, without depending on symmetry of the circuit, it is possible to generate the differential-amplified detection signal immediately after the detection signals DS1 and DS2 are output.

Second Embodiment

Figure 8:
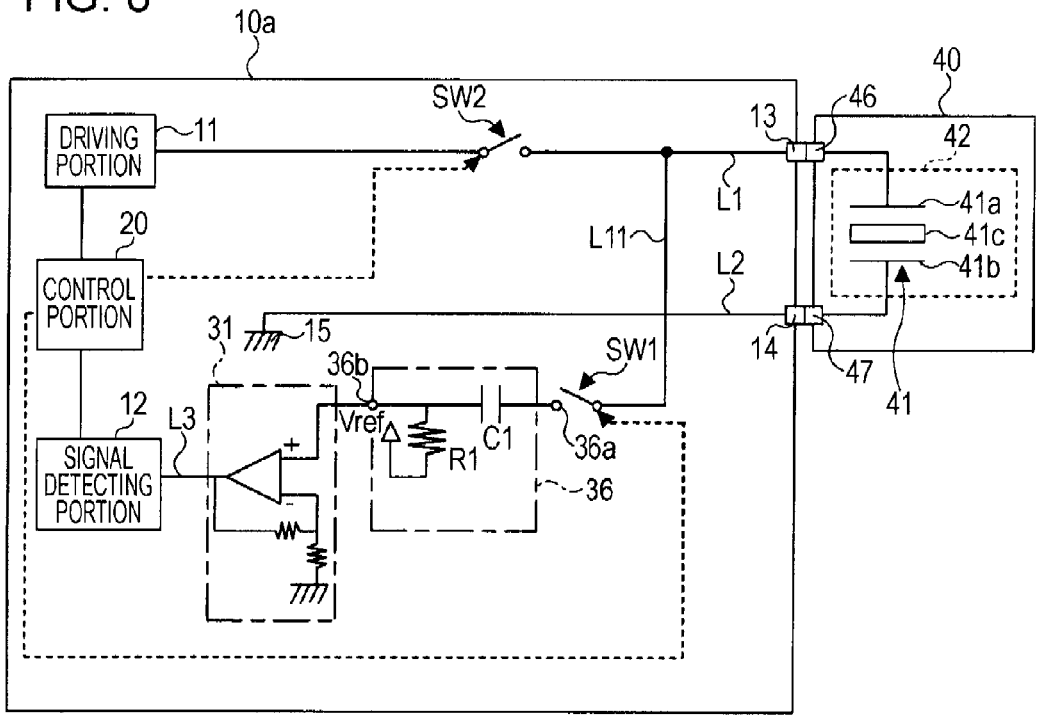
FIG. 8 is a view that schematically illustrates the internal configuration of a liquid detection device according to a second embodiment.
Figures 9, 10:
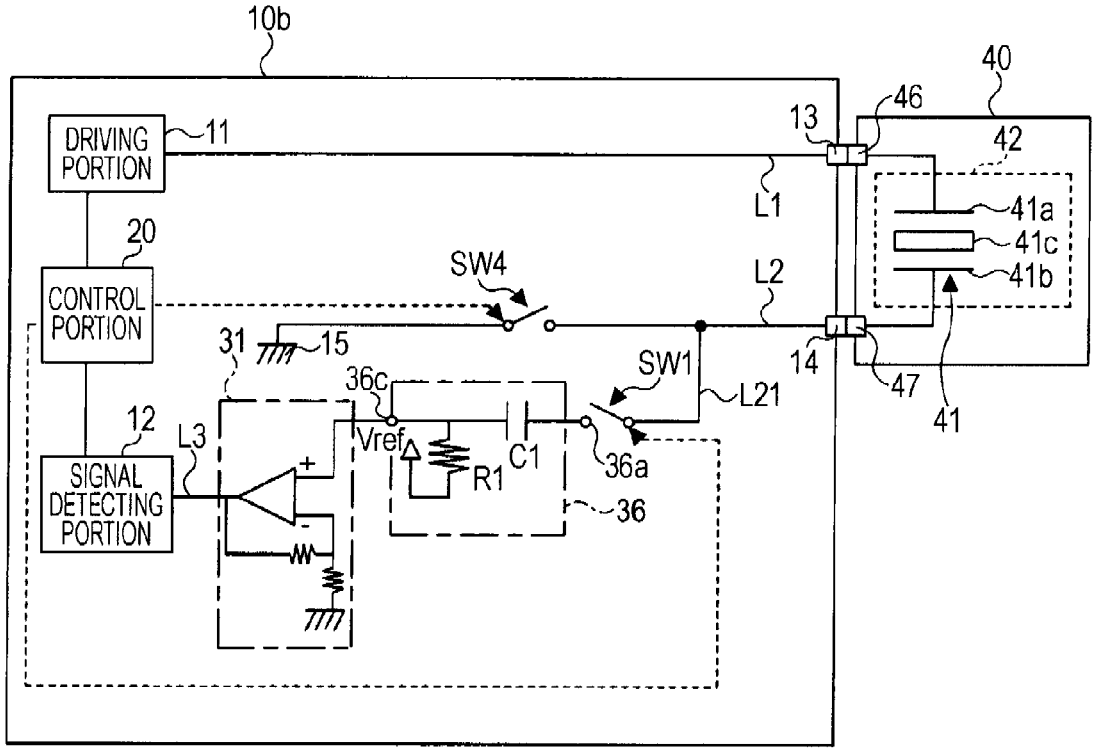
FIG. 9 is a view that illustrates one example of on/off control patterns of switches, which are used in the second embodiment, in each mode.
FIG. 10 is a view that schematically illustrates the internal configuration of a liquid detection device according to a third embodiment.

The configuration of a liquid detection device according to a second embodiment will be described with reference to FIG. 8 and FIG. 9. FIG. 8 is a view that schematically illustrates the internal configuration of the liquid detection device according to the second embodiment. FIG. 9 is a view that illustrates one example of on/off control patterns of switches, which are used in the second embodiment, in each mode. The differential detection is performed using the two detection signals DS1 and DS2 in the first embodiment; however, detection of liquid is performed using only the detection signal DS1 in the second embodiment. Note that, among the components of the liquid detection device 10*a* according to the second embodiment, the same reference numerals are assigned to the same or similar components to those of the liquid detection device 10 according to the first embodiment, and the description thereof is omitted.

In the liquid detection device 10*a* according to the second embodiment, liquid is detected using the detection signal DS1 that is output to the first signal line L1 and the first detection signal line L11, both of which are connected to the driving portion 11. A high-pass filter portion 36, which is provided in the liquid detection device 10*a* according to the second embodiment, includes an input portion 36*a* and an output portion 36*b*. The input portion 36*a* is connected to the first detection signal line L11 through the first switch SW1. The output portion 36*b* is used to output a detection signal of which a direct current component is removed. The liquid detection device 10*a* according to the second embodiment includes an amplifier 31. The amplifier 31 is configured as a noninverting amplifier circuit, and includes a positive input portion that is connected to the output portion 36*b* of the high-pass filter portion 36 and a negative input portion that is grounded. Note that the high-pass filter portion 36 may be pulled down to a ground electric potential instead of being pulled down to the reference electric potential Vref.

In the liquid detection device 10*a* according to the second embodiment as constructed above, when liquid is detected, the CPU 21 executes the switch change over module M3 to thereby turn on the first switch SW1 and the second switch SW2. The CPU 21 executes the voltage control module M1 to thereby output a preliminary charging voltage from the driving portion 11. As a result, the capacitor portion C1 of the high-pass filter portion 36 is charged with the preliminary charging voltage. Note that the second switch SW2 need not be provided in the first signal line L1. For example, it is applicable that the first signal line L1 may be interrupted from the driving signal source inside the driving portion 11.

The CPU 21 executes the switch change over module M3 to thereby turn off the first switch SW1 and turn on the second switch SW2. The CPU 21 executes the voltage control module M1 to thereby output the driving signal from the driving portion 11. As a result, the driving signal is applied to the liquid detecting portion 41 and, hence, the piezoelectric element 41*c* is electrostricted.

The CPU 21 executes the switch change over module M3 to thereby turn off the second switch SW2 and turn on the first switch SW1. As a result, the detection signal DS1 is output from the first electrode 41*a* of the liquid detecting portion 41 to the first signal line L1 and the first detection signal line L11. Because the capacitor portion C1 of the high-pass filter portion 36 is preliminarily charged with the preliminary charging voltage in advance, the intermediate electric potential of the detection signal DS1 immediately converges on a reference electric potential in the high-pass filter portion 36. That is, a direct current component of the detection signal DS1 is removed or reduced by the high-pass filter portion 36 from the beginning. The detection signal DS1, of which a direct current component is removed in the high-pass filter portion 36, is input to the amplifier 31 and is amplified.

The CPU 21 executes the detection module M2 to thereby determine whether a predetermined amount or above of liquid is present in the liquid containing body 40 using the waveform of an amplified detection signal that is output from the amplifier 31. According to the second embodiment, even when only the detection signal DS1 output from the first electrode 41*a* of the liquid detecting portion 41 is used, it is possible to converge the intermediate electric potential of the detection signal DS1 on the reference electric potential Vref by the high-pass filter portion 36 immediately after the detection signal DS1 has been output. Thus, at the timing at which the amplitude of the detection signal DS1 is large, it is possible to detect the presence or absence of liquid and it is also possible to set the withstand voltage of the high-pass filter portion 36 to a lower value.

Third Embodiment

Figures 11, 12:
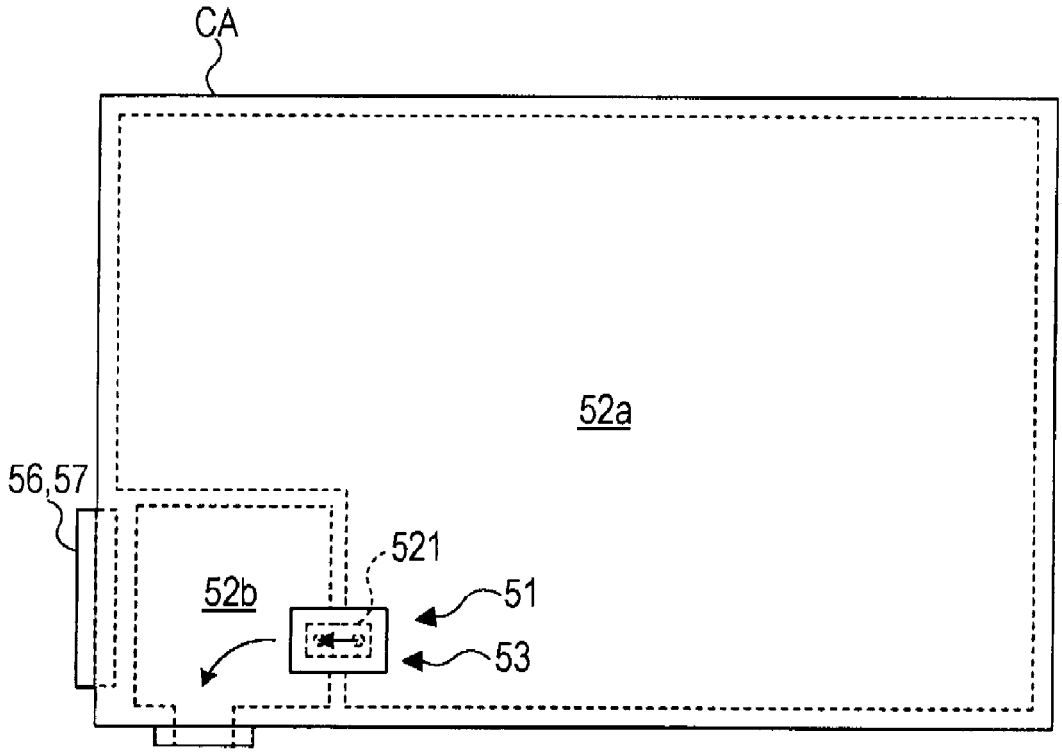
FIG. 11 is a view that illustrates one example of on/off control patterns of switches, which are used in the third embodiment, in each mode.
FIG. 12 is a side view of an ink cartridge, which serves as a liquid containing body, that is attached to the liquid detection device according to the first to third embodiments and then used.

The configuration of a liquid detection device according to a third embodiment will be described with reference to FIG. 10 and FIG. 11. FIG. 10 is a view that schematically illustrates the internal configuration of the liquid detection device according to the third embodiment. FIG. 11 is a view that illustrates one example of on/off control patterns of switches, which are used in the third embodiment, in each mode. The detection is performed using the detection signal DS1 in the second embodiment; however, detection of liquid is performed using only the detection signal DS2 in the third embodiment. Note that the configuration of the liquid detection device 10*b* according to third embodiment has the same configuration as that of the liquid detection device 10 or that of the liquid detection device 10*a*, so that the same reference numerals are assigned to the same components and the description thereof is omitted.

In the liquid detection device 10*b* according to the third embodiment, liquid is detected using the detection signal DS2 that is output to the second signal line L2 and the second detection signal line L21, both of which are connected to the ground portion 15. The high-pass filter portion 36, which is provided in the liquid detection device 10*b* according to the third embodiment, is connected to the second detection signal line L21 through the first switch SW1. Note that the high-pass filter portion 36 may be pulled down to a ground electric potential instead of being pulled up to the reference electric potential Vref.

In the liquid detection device 10*b* according to the third embodiment as constructed above, when liquid is detected, the CPU 21 executes the switch change over module M3 to thereby turn on the first switch SW1 and the fourth switch SW4. The CPU 21 executes the voltage control module M1 to thereby output a preliminary charging voltage from the driving portion 11. As a result, the capacitor portion C1 of the high-pass filter portion 36 is charged at the reference electric potential.

The CPU 21 executes the switch change over module M3 to thereby turn off the first switch SW1 and turn off the fourth switch SW4. The CPU 21 executes the voltage control module M1 to thereby output a driving signal from the driving portion 11. As a result, the driving signal is applied to the liquid detecting portion 41 and, hence, the piezoelectric element 41*c* is electrostricted.

The CPU 21 executes the switch change over module M3 to thereby turn off the fourth switch SW4 and turn on the first switch SW1. As a result, the detection signal DS2 is output from the second electrode 41*b* of the liquid detecting portion 41 to the second signal line L2 and the second detection signal line L21. Because the capacitor portion C1 of the high-pass filter portion 36 is preliminarily charged at the reference electric potential in advance, the electric potential of the detection signal DS2 immediately converges on a reference electric potential in the high-pass filter portion 36. That is, a direct current component of the detection signal DS2 is removed or reduced by the high-pass filter portion 36 from the beginning. The detection signal DS2, of which a direct current component is removed in the high-pass filter portion 36, is input to the amplifier 31 and is amplified.

The CPU 21 executes the detection module M2 to thereby determine whether a predetermined amount or above of liquid is present in the liquid containing body 40 using the waveform of an amplified detection signal that is output from the amplifier 31. According to the third embodiment, even when only the detection signal DS2 output from the second electrode 41*b* of the liquid detecting portion 41 is used, it is possible to converge the electric potential of the detection signal DS2 on the reference electric potential Vref by the high-pass filter portion 36 immediately after the detection signal DS2 has been output. Thus, at the timing at which the amplitude of the detection signal DS2 is large, it is possible to detect the presence or absence of liquid and it is also possible to set the withstand voltage of the high-pass filter portion 36 to a lower value.

Figure 13:
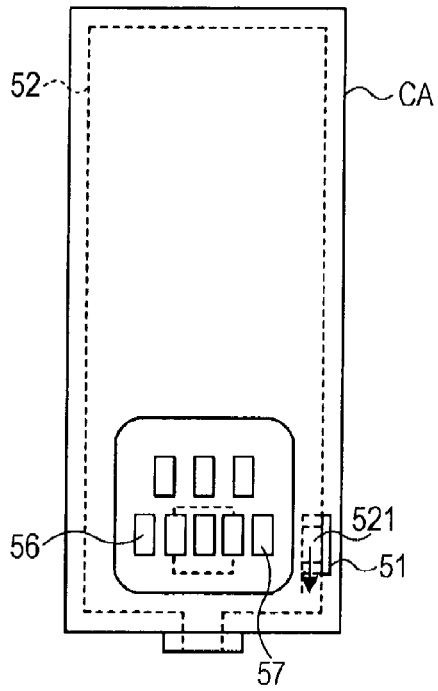
FIG. 13 is a front view of the ink cartridge, which serves as the liquid containing body, that is attached to the liquid detection device according to the first to third embodiments and then used.
Figure 14:
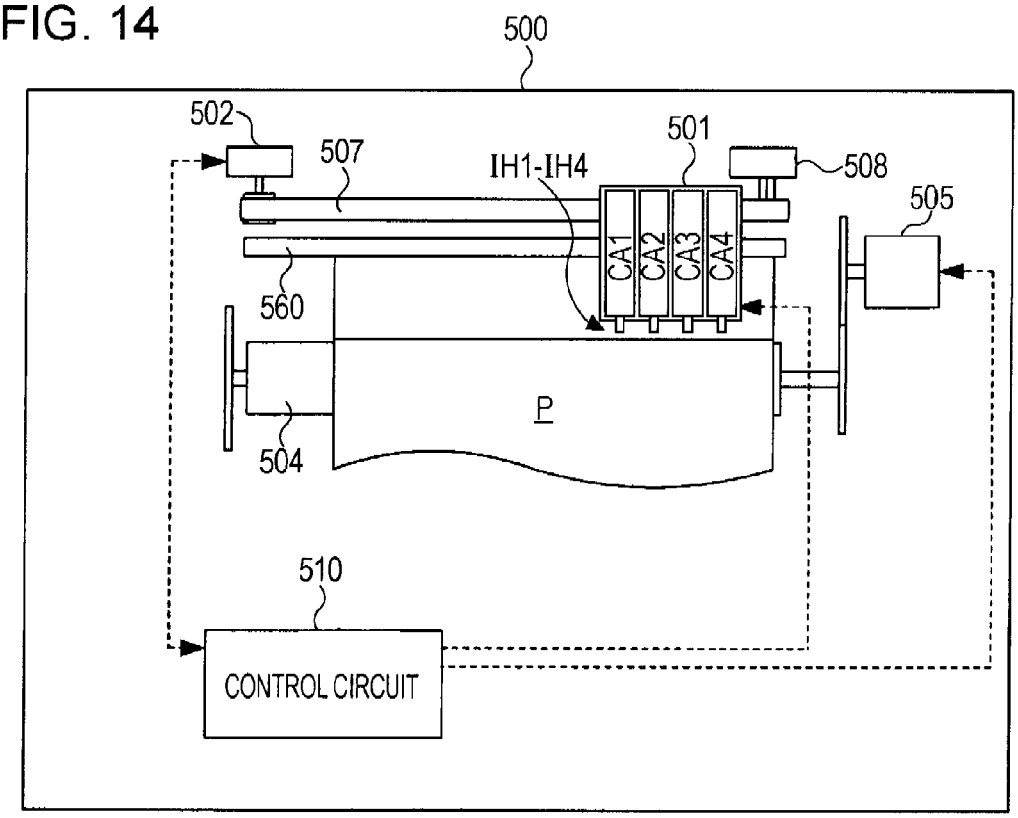
FIG. 14 is a view that schematically illustrates the functional configuration of a printer, which serves as a liquid ejecting apparatus, according to the first to third embodiments.

With reference to FIG. 12 to FIG. 14, an application example of the liquid detection device 10 and the liquid containing body 40 according to the first to third embodiments will be described. FIG. 12 is a side view of an ink cartridge, which serves as the liquid containing body, that is attached to the liquid detection device according to the first to third embodiments and then used. FIG. 13 is a front view of the ink cartridge, which serves as the liquid containing body, that is attached to the liquid detection device according to the first to third embodiments and then used. FIG. 14 is a view that schematically illustrates the functional configuration of a printer, which serves as a liquid ejecting apparatus that uses the liquid detection device, according to the first to third embodiments.

As shown by the broken lines in FIG. 12 and FIG. 13, the ink cartridge CA according to the present application example includes a detecting portion 51, which serves as the liquid detecting portion 41, a first ink containing portion 52*a* and a second ink containing portion 52*b*.

In the ink cartridge CA, the detecting portion 51 is arranged on the side face of the ink cartridge CA. The detecting portion 51 includes an ink amount sensor (piezoelectric element) 53 that detects whether a communication passage 521, which establishes fluid communication between the first ink containing portion 52*a* and the second ink containing portion 52*b*, is filled with ink or ink is not present in the communication passage 521. That is, the detecting portion 51 detects whether the amount of ink in the ink cartridge CA is equal to a predetermined amount or below by detecting whether the communication passage 521 is filled with ink or ink is not present in the communication passage 521.

The communication passage 521 is a thin passage that causes a capillary force, and is able to suppress or prevent air bubbles that have been included in the first ink containing portion 52*a* or the second ink containing portion 52*b* from entering the communication passage 521. In this manner, it is possible to suppress or prevent the situation in which, because of the presence of air bubbles around the ink amount sensor 53, the ink amount sensor 53 erroneously detects an ink end. On the other hand, as ink in the first ink containing portion 52*a* becomes empty, large amounts of air bubbles enter the communication passage 521. Thus, the ink end, which should be originally detected, is detected by the ink amount sensor 53.

If ink is present in the first ink containing portion 52*a*, the communication passage 521 is filled with ink. On the other hand, if ink is not present in the first ink containing portion 52*a*, strictly speaking, if ink is present only in the second ink containing portion 52*b*, the communication passage 521 is not filled with ink. Thus, in the present application example, the predetermined amount may be regarded as the amount of ink contained in the second ink containing portion 52*b*. In addition, in the present application example, the state in which the ink containing portion is empty may be regarded as a state in which the communication passage 521 is not filled with ink.

The ink amount sensor 53 may be arranged so as to directly contact ink or may be, for example, arranged indirectly with respect to ink through a member that is able to improve the detection characteristics.

The printer 500, as shown in FIG. 14, includes a control circuit 510 and a printing portion. The printing portion includes a mechanism that discharges ink and forms dots by driving print heads IH1 to IH4 mounted on a carriage 501, a mechanism that reciprocally moves the carriage 501 in the axial direction of a platen 504 by a carriage motor 502, and a mechanism that transports a sheet of printing paper P by a paper feeding motor 505. The mechanism that reciprocally moves the carriage 501 in the axial direction of the platen 504 includes a sliding shaft 506, a pulley 508, a position detection sensor (not shown), and the like. The sliding shaft 506 is provided so as to extend parallel to the axis of the platen 504 and slidably holds the carriage 501. An endless driving belt 507 is looped around the pulley 508 and the carriage motor 502. The position detection sensor detects the origin position of the carriage 501. The mechanism that transports a sheet of printing paper P includes the platen 504, the paper feeding motor 505, a paper feeding auxiliary roller (not shown), and a gear train (not shown). The paper feeding motor 505 rotates the platen 504. The gear train transmits the rotation of the paper feeding motor 505 to the platen 504 and the paper feeding auxiliary roller.

Attachment portions are formed in the carriage 501, and ink cartridges CA1 to CA4 are respectively attached to the attachment portions. The ink cartridge CA1 contains black (K) ink, the ink cartridge CA2 contains cyan (C) ink, the ink cartridge CA3 contains magenta (M) ink, and the ink cartridge CA4 contains yellow (Y) ink. Note that, other than the above, the ink cartridge CA of light cyan (LC) ink, light magenta (LM) ink, dark yellow (DY) ink, light black (LB) ink, red (R) ink, or blue (B) ink may be attached.

The above described group of terminals are provided on each of the attachment portions of the carriage 501. The control circuit 510 applies a driving signal to the detecting portion 51 and acquires a detection signal in such a manner that the above group of terminals contact the first terminal 56 and the second terminal 57 provided in each of the ink cartridges CA.

The control circuit 510 executes a printing process and an ink amount detecting process in the printer 500. The control circuit 510, as in the case of the control portion 20, includes a central processing unit (CPU) (not shown), a memory, an input/output interface (I/O), and an internal bus.

Figure 15:
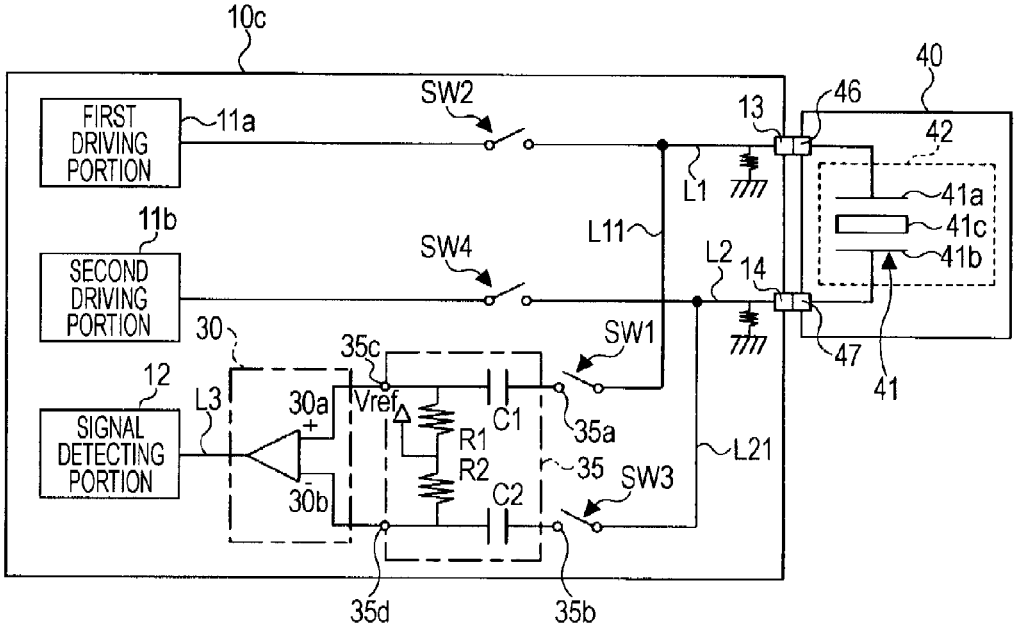
FIG. 15 is a view that schematically shows the internal configuration of a liquid detection device according to another embodiment.

Other Embodiments (1) In the above described embodiments, the description is made using the liquid detection device 10 that includes the single driving portion 11; however, as shown in FIG. 15, a liquid detection device 10*c* that includes two driving portions, that is, a first driving portion 11*a* and a second driving portion 11*b* corresponding to the two electrodes 41*a* and 41*b* of the liquid detecting portion 41, may be used. FIG. 15 is a view that schematically shows the internal configuration of the liquid detection device according to another embodiment.

When the liquid detection device 10*c* is used, the first to fourth switches SW1 to SW4 are turned on by a control portion (not shown). The control portion requests an output of a preliminary charging voltage to the first driving portion 11*a* and the second driving portion 11*b*. As a result, the capacitor portions C1 and C2 of the high-pass filter portion 35 are preliminarily charged. The control portion changes the first to fourth switches SW1 to SW4 over to any one of the modes that are described as the state of driving in the first to third embodiments. The control portion allows a driving signal to be applied to the liquid detecting portion 41 using the first driving portion 11*a* and the second driving portion 11*b*. The control portion changes the first to fourth switches SW1 to SW4 over to any one of the modes that are described as the state of detecting in the first to third embodiments. As a result, detection signals output from the liquid detecting portion 41 are input to the high-pass filter portion 35 and then the intermediate electric potentials of the detection signals are converged on the reference electric potential Vref. Each detection signal of which a direct current component is removed or reduced is input from the high-pass filter portion 35 to the differential amplifier 30, and then a differential-amplified detection signal is input to the signal detecting portion 12.

(2) In the above embodiments, the description is made by taking the case in which the liquid detection device is separately formed from the liquid detecting portion for example; however, the liquid detecting portion may be provided in the liquid detection device. In this case as well, the same advantageous effects as those obtained in the above embodiments may be obtained.

(3) In the above embodiment, the description is made by taking the ink jet printer, for example, as an application example of the liquid detection device 10; however, other than this, it is applicable that the liquid detection device 10 may be implemented as a device that detects the presence or absence of liquid, such as a fuel amount detection device that detects a minimum fuel amount in a fuel tank, for example.

The aspects of the invention are described on the basis of embodiments and alternative embodiments; however, the above described embodiments of the invention are intended to easily understand the aspects of the invention and are not intended to limit the aspects of the invention.

The invention may be modified or improved without departing from the spirit of the invention or the scope of the appended claims, and the invention also encompasses their equivalents.

What is claimed is:

1. A liquid detection device that drives a liquid detecting portion, comprising:

a driving portion that supplies a driving signal or a preliminary charging voltage to the liquid detecting portion;

a signal detecting portion that receives a detection signal from the liquid detecting portion;

a high-pass filter portion that has a capacitor portion and that is arranged between the liquid detecting portion and the signal detecting portion;

a first switch that is arranged between the liquid detecting portion and the high-pass filter portion, and that electrically connects or interrupts a line between the liquid detecting portion and the high-pass filter portion;

a control portion configured to control the driving portion and the first switch to execute detection of liquid such that the driving portion applies the driving signal to the liquid detecting portion when the first switch is turned off; and a second switch that is arranged between the driving portion and the liquid detecting portion and that is controlled by the control portion to electrically connect or interrupt a line between the driving portion and the liquid detecting portion, wherein the control portion, before the driving signal is applied to the liquid detecting portion, is configured to control the first switch to electrically connect a line between the liquid detecting portion and the high-pass filter portion, to control the second switch to electrically connect a line between the driving portion and the liquid detecting portion, and to control the driving portion to apply the preliminary charging voltage to the liquid detecting portion;

the control portion, when liquid is detected, controls the first switch to electrically interrupt a line between the liquid detecting portion and the high-pass filter portion, controls the second switch to electrically connect a line between the driving portion and the liquid detecting portion, and controls the driving portion to apply the driving signal to the liquid detecting portion at a first phase, and the control portion then controls the first switch to electrically connect a line between the liquid detecting portion and the high-pass filter portion, and controls the second switch to electrically interrupt a line between the driving portion and the liquid detecting portion at a next phase after the first phase.

2. The liquid detection device according to claim 1, wherein the first switch is arranged between the liquid detecting portion and the capacitor portion.

3. The liquid detection device according to claim 1, wherein the liquid detecting portion includes a plurality of terminals and is provided on a liquid containing body that is detachable from the liquid detection device, wherein the liquid detection device further comprises a plurality of device terminals that are formed at an attachment portion that attaches the liquid containing body, and that contact the terminals of the liquid detecting portion, wherein the plurality of device terminals include a first attachment terminal and a second attachment terminal that is different from the first device terminal, and wherein the driving portion is electrically connected to the first attachment terminal, and the signal detecting portion is electrically connected to the first attachment terminal or the second attachment terminal.

4. The liquid detection device according to claim 1, wherein the liquid detecting portion includes a first electrode and a second electrode, wherein the high-pass filter portion includes first and second input portions that are electrically connected to the first and second electrodes, respectively, wherein the first switch is arranged between the first electrode and the first input portion, wherein the liquid detection device further comprises:

a ground portion;

a second switch that is arranged between the driving portion and the first electrode and that electrically connects or interrupts a line between the driving portion and the first electrode;

a third switch that is arranged between the second input portion and the second electrode and that electrically connects or interrupts a line between the second input portion and the second electrode; and a fourth switch that is arranged between the ground portion and the second electrode and that electrically connects or interrupts a line between the ground portion and the second electrode.

5. The liquid detection device according to claim 4, wherein the liquid detecting portion outputs mutually opposite-phase detection signals by receiving an input of the driving signal, wherein the high-pass filter portion includes first and second output portions, wherein the liquid detection device further comprises:

a differential amplifier that is arranged between the signal detecting portion and the high-pass filter portion, that includes first and second input portions to which the first and second output portions of the high-pass filter portion are electrically connected, respectively, and that performs differential amplification on the mutually opposite-phase detection signals.

6. The liquid detection device according to claim 4, wherein the liquid detecting portion includes a plurality of terminals and is provided on a liquid containing body that is detachable from the liquid detection device, wherein the liquid detection device further comprises a plurality of device terminals that are formed at an attachment portion that attaches the liquid containing body, and that contact the terminals of the liquid detecting portion, wherein the plurality of device terminals include a first attachment terminal and a second attachment terminal that is different from the first attachment terminal, and wherein the driving portion is electrically connected to the first attachment terminal, the ground portion is electrically connected to the second attachment terminal, and the signal detecting portion is electrically connected to the first attachment terminal and the second attachment terminal.

7. The liquid detection device according to claim 1, wherein the control portion, before the driving signal is applied to the liquid detecting portion, controls the first switch to electrically connect a line between the liquid detecting portion and the high-pass filter portion, and controls the driving portion to apply the preliminary charging voltage to the liquid detecting portion.

8. The liquid detection device according to claim 7, wherein the control portion, when liquid is detected, controls the first switch to electrically interrupt a line between the liquid detecting portion and the high-pass filter portion, controls the driving portion to apply the driving signal to the liquid detecting portion, and wherein the control portion then controls the first switch to electrically connect a line between the liquid detecting portion and the high-pass filter portion, and controls the driving portion to stop applying the driving signal to the liquid detecting portion.

9. The liquid detection device according to claim 1, wherein the driving signal is biased to a predetermined electric potential, and wherein the electric potential of the preliminary charging voltage is the predetermined electric potential.

10. A liquid ejecting apparatus comprising the liquid detection device according to claim 1.

11. A method of detecting liquid in a liquid detection device, comprising:

electrically connecting a line between a liquid detecting portion and a high-pass filter portion;

applying a preliminary charging voltage to the liquid detecting portion when the line between the liquid detecting portion and the high pass filter is connected;

electrically interrupting the line between the liquid detecting portion and the high-pass filter portion;

applying a driving signal to the liquid detecting portion when the line between the liquid detecting portion and the high-pass filter portion is interrupted;

electrically connecting the line between the liquid detecting portion and the high-pass filter portion; and detecting the presence or absence of the liquid using a detection signal output from the liquid detecting portion through the high-pass filter portion.

* * * * *